US008920532B2

(12) United States Patent
Jimenez et al.

(10) Patent No.: US 8,920,532 B2
(45) Date of Patent: Dec. 30, 2014

(54) INOCULATION PROCESS AND DEVICE

(75) Inventors: Luis Cobos Jimenez, San Sebastian (ES); Francisco Rodríguez Vázquez, San Sebastian (ES); Jose Luis Oncala Avilés, San Sebastian (ES); Pedro Carnicer Alfonso, San Sebastian (ES)

(73) Assignee: Fundacion Tecnalia Research & Innovation, San Sebastian (ES)

( * ) Notice: Subject to any disclaimer, the term of this patent is extended or adjusted under 35 U.S.C. 154(b) by 86 days.

(21) Appl. No.: 13/512,050

(22) PCT Filed: Nov. 25, 2009

(86) PCT No.: PCT/ES2009/070529

§ 371 (c)(1),
(2), (4) Date: Jul. 25, 2012

(87) PCT Pub. No.: WO2011/064415

PCT Pub. Date: Jun. 3, 2011

(65) Prior Publication Data

US 2012/0279349 A1 Nov. 8, 2012

(51) Int. Cl.

| | |
|---|---|
| ***C22C 33/00*** | (2006.01) |
| ***B22D 1/00*** | (2006.01) |
| ***C21C 1/00*** | (2006.01) |
| ***C21D 5/00*** | (2006.01) |
| ***C21C 1/08*** | (2006.01) |
| ***C21C 1/10*** | (2006.01) |
| ***C21D 5/14*** | (2006.01) |
| ***C22C 33/08*** | (2006.01) |
| ***C22C 37/00*** | (2006.01) |

(52) U.S. Cl.

CPC . *B22D 1/007* (2013.01); *C21C 1/08* (2013.01); *C21C 1/105* (2013.01); *C21D 5/00* (2013.01); *C21D 5/14* (2013.01); *C22C 33/08* (2013.01); *C22C 37/00* (2013.01)

USPC ..... 75/10.22; 75/10.6; 75/10.61; 75/386; 373/22; 373/25

(58) Field of Classification Search

USPC ..... 75/10.22, 10.61, 10.6, 386; 373/22, 25

See application file for complete search history.

(56) References Cited

U.S. PATENT DOCUMENTS 4,180,396 A 12/1979 Caspers
4,246,023 A * 1/1981 Savov et al. ..... 75/10.41

(Continued)

FOREIGN PATENT DOCUMENTS

CN 2 156 967 Y 2/1994
CN 201 217 070 Y 4/2009

(Continued)

OTHER PUBLICATIONS

Written translation of JP 58100951 A from the Japanese by Katayama et al. Published Jun. 15, 1983.*

(Continued)

*Primary Examiner* — George Wyszomierski
*Assistant Examiner* — Tima M McGuthry Banks
(74) *Attorney, Agent, or Firm* — Gary J. Gershik; Cooper & Dunham LLP

(57) ABSTRACT

The present invention describes an inoculation process for inoculating a nucleating additive to a cast iron alloy in a pouring distributor by means of using a transferred arc plasma torch, with an anode partially immersed in the cast iron alloy and a cathode located on the surface of said alloy, the anode or the cathode or both comprising graphite, preferably synthetic crystalline graphite, which supplies said nucleating additive to the iron alloy. The invention thus describes an inoculation device useful for carrying out the inoculation process.

15 Claims, 6 Drawing Sheets

(56) References Cited

U.S. PATENT DOCUMENTS

| | | | | | |
|---|---|---|---|---|---|
| 4,252,559 | A | | 2/1981 | Allain | |
| 4,646,318 | A | * | 2/1987 | Nordmeyer et al. | 373/105 |
| 4,694,464 | A | * | 9/1987 | Camacho | 373/22 |
| 4,737,261 | A | * | 4/1988 | Hoover | 208/50 |
| 8,419,821 | B2 | * | 4/2013 | Wang et al. | 75/10.63 |

FOREIGN PATENT DOCUMENTS

| | | | | | |
|---|---|---|---|---|---|
| EP | 696879 | A2 | * | 2/1996 | H05B 7/00 |
| GB | 2 069 898 | A | | 9/1981 | |
| JP | 53 137814 | A | | 12/1978 | |
| JP | 55 122652 | A | | 9/1980 | |
| JP | 58100951 | A | * | 6/1983 | B22D 11/10 |
| JP | 2002 047510 | A | | 2/2002 | |

OTHER PUBLICATIONS

International Search Report issued by the International Searching Authority (ISA/O.E.P.M.) on May 25, 2010 in connection with International Application No. PCT/ES2009/070529.

* cited by examiner

INOCULATION PROCESS AND DEVICE

This application is a §371 national stage application of PCT International Application No. PCT/ES2009/070529, filed Nov. 25, 2009, the contents of all of which are hereby incorporated by reference into this application.

TECHNICAL FIELD OF THE INVENTION

The present invention relates to a new inoculation process for inoculating a (gray or nodular) cast iron and especially a molten iron bath contained in a pouring device (trough, furnace or ladle) arranged between the outlet of a melting furnace and the line of molds. The inoculation allows modifying the base metallographic structure, being able to affect the shape, the size and as well as the distribution of graphite in the metal matrix. The present invention likewise relates to a device for putting said inoculation process into practice.

BACKGROUND OF THE INVENTION

The manufacture of cast iron parts requires the use of certain additives known as inoculants which are incorporated into the molten iron bath during the melting and/or pouring process to obtain the desired metallographic structure and to ensure the internal health of the parts.

Inoculation is defined as the supply to a metal bath in the moment prior to the pouring of certain alloys in order to cause changes in the distribution of the graphite, improvements in the mechanical characteristics and the reduction of the tendency for whitening.

The purpose of the inoculation is the generation of germination nuclei on which the solid phases grow during solidification.

In certain cases, these seeds result from the addition of fine particles of the same phase to be solidified. These particles are not completely dissolved, giving rise to the growth of crystals. Thus, for example, the addition of graphitic carbon to a cast iron in the moment prior to the pouring promotes the nucleation of the graphite in the metal bath and prevents undercooling during solidification. However, the carbon used as additive must have a high degree of crystallization to generate nucleation seeds which enable the precipitation of the carbon in graphitic form.

This same effect can be obtained from particles of materials different from those of solidification. The increase of the number of nuclei in the molten metal favors that eutectic solidification, and especially graphitic precipitation, can take place with a minimal undercooling, which reduces the tendency for the formation of eutectic carbides and favor the precipitation of graphite. Most of the inoculants used today contain from 45 to 75% Si and variable percentages of Ca and Al mainly (the pure Si alloys are not effective in inoculation). Depending on the nature of the characteristics of the parts to be manufactured and available manufacturing processes, they can incorporate variable amounts of other elements such as Ca, Ba, Mg, Mn and Zr which are used to increase the solubility and/or the strength of the inoculant.

The inoculation can be carried out inside or outside the mold. The traditional process for external inoculation, and the most common one, consists of adding inoculant in the metal stream coming from the transfer of treatment ladle during the filling of the pouring ladle. The intention is to obtain a homogeneous mixture and a good dilution of the inoculant. This process has considerable limitations which affect both the weight of metal to be treated (it is not valid for small amounts) and the useful pouring time (the fading of the inoculating effect is very quick).

In the inoculation outside the mold, materials which are granulated or in the form of wire which are incorporated to the molten metal in various ways and at different points of the pouring line are used.

Patent GB 2069898 describes a process for wire inoculation for a pressure pouring furnace, wherein the inoculant material is incorporated to the passage of molten metal in the outlet runner of the tank, leading the molten metal to the pouring spout, at the opposite end of which is the pouring nozzle through which the mold is filled. As is inferred from the design set forth, this process has several operative defects or limitations, mainly derived from the regularity of the pouring flow. It is evident that a stop in the molding line causes the corresponding stop in the pouring unit, with the subsequent fading of the inoculating effect and the rapid cooling of the metal exposed in the open spout.

A way to prevent the mentioned problem consists of projecting inoculant particles on the pouring stream in the exact moment in which the latter enters the mold. An inoculation process of this type is described in patent JP 55122652. In this case, the drawback of the operation translates into an irregular and generally low yield, due to the loss of material occurring because of the projection itself and because of the rebound of part of the particles on the metal stream. These projection methods have an added drawback which is the difficulty in adapting the flow rate to the metal flow rate due to the fact that it occurs in the precise moment of the filling. The usual practice consists of establishing a fixed inoculant flow rate according to the average pouring flow rate, taking into account that while a mold is filled, the flow rate can range between hundreds of grams and several kilos per second. During a conventional mold filling operation, it is evident that there is a lack of proportionality, i.e., that there will be over-inoculated parts compared to other under-inoculated parts in the mold, which can give rise to defects of a contrary nature in the same mold.

In relation to the aforementioned inoculation with graphitic carbon, it can be emphasized that C has in the Fe—C diagram a saturation at the eutectic point ($T_E$=1153° C.) of 4.26%. The alloying elements increase or decrease the temperature of this saturation point. In the inoculation with graphite, the solubility must be carefully observed. As soon as the graphitic carbon supplied dissolves, it loses its properties as a germinator, which involves a quick fading of its effect in an uncontrolled manner according to the temperature, chemical composition and degree of stirring of the hotmelt. This makes the inoculation with graphite be a little used process.

This inoculation can be indispensable in extreme conditions of the casting, such as perished metals, with low $O_2$ content, which cause a weak reaction to the germination with oxides. In this case the incorporation of the graphite must be carried out right before filling the mold, which involved a low temperature and short waiting time for the solidification.

The appearance on the market of pouring furnaces with an inductor and pressurized with nitrogen involved a great improvement in the manufacturing processes and translated into an immediate increase of productivity. However, the quality and the manufacturing costs did not benefit equally since the new furnaces introduced new specific problems derived from their own conception and design.

These furnaces allow maintaining the metal available for the pouring for more time since the two main drawbacks mentioned above, i.e., the loss of temperature of the metal and the fading of the magnesium (in nodular cast iron) are corrected. However, it has a very important general operation problem: the furnace must always be maintained with molten metal covering the inductor, therefore the latter must always be running. The loss of metallurgical quality experienced by the metal during its recirculation through the inductor must be added to the costs derived from the maintenance of the metal during non-operative periods. It has been verified that the main parameters for controlling he cooling curve (temperature of the eutectic and recalescence) experience a progressive linear degradation according to the temperature of the metal and the dwell time in the tank.

Two already mentioned techniques are used to compensate and correct this deterioration: the metal is first inoculated during the filling of the furnace by means of supplying the material to the stream of the transfer ladle; the metal is then inoculated in the pouring stream by projection in the moment in which the mold is filled. The combination of these two techniques allows an acceptable degree of control over the metallurgical quality and is currently the commonly used process in castings which have this type of furnace.

However, the sum of negative aspects i.e., the process accumulates the defect of the fading and that of the lack of proportionality and efficiency of the inoculant, is counterposed to the sum of positive aspects. The defect of generation of slag occurring due to the supply of solid alloying agents in the pouring phase must be added to this.

Therefore, there is still a need in the state of the art to provide a new inoculation process for inoculating a cast iron which at least partly overcomes the mentioned drawbacks.

DESCRIPTION OF THE INVENTION

Figure 1:
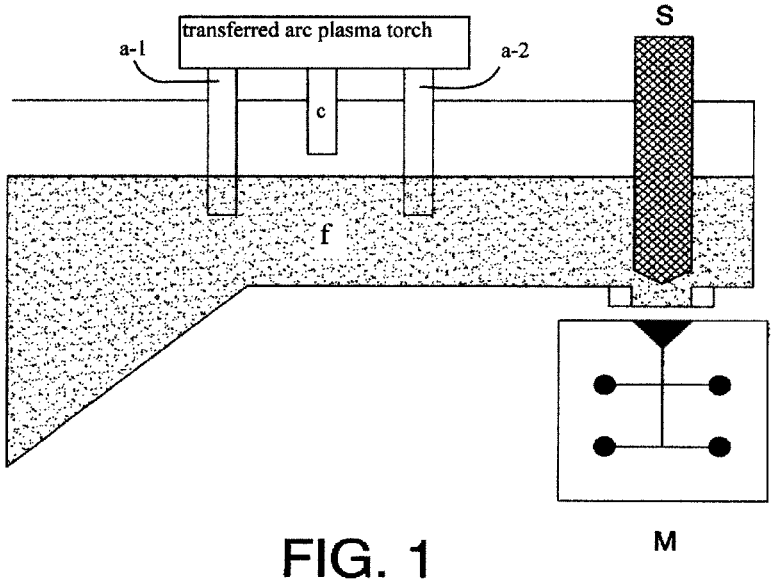
FIG. 1 is a diagram of a pouring distributor with a runner or spout configuration of a pouring furnace in which a-1 or a-2 indicates that the anode can be upstream or downstream of the cathode; c is the cathode; S is the cylinder for closing the nozzle for the exit of metal to the mold (stopper); f is the cast iron and M the mold.
Figure 2:
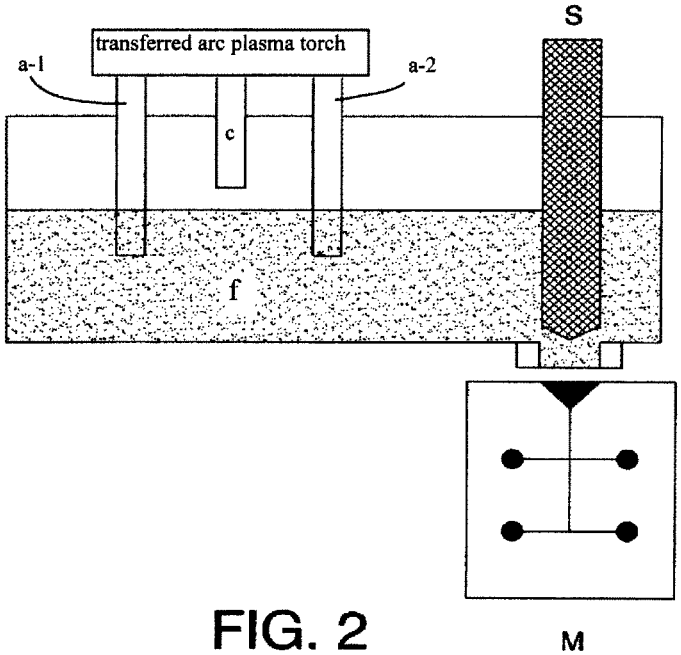
FIG. 2 is a diagram of a pouring distributor with a trough configuration in which a-1 or a-2 indicates that the anode can be upstream or downstream of the cathode.

The present invention relates in a first aspect to a process for the inoculation of an additive to a cast iron alloy which comprises establishing a plasma arc between the surface of said alloy and a cathode of a transferred arc plasma torch arranged in a pouring distributor located before the line of molds. In the field of the present invention, pouring distributor is understood as a pouring device arranged between the outlet of a melting furnace and the line of molds. It is also understood that the cast iron alloy contained in the pouring distributor is moving towards the line of molds.

The mentioned plasma torch comprises an anode partially immersed in the cast iron alloy and a cathode arranged on the alloy.

In a particular embodiment, the cathode comprises graphite and the anode is any conventional anode. In another particular embodiment, the anode comprises graphite and the cathode is any conventional cathode. In another particular embodiment, the cathode and the anode comprise graphite. The graphite of the cathode, of the anode or of both supplies the nucleating additive to the iron alloy. In the scope of the present invention, said additive is carbon species detached from the anode, or from the cathode or from both, and carbon species are understood as those which comprise one or more carbon atoms charged with one or more positive charges.

In a preferred embodiment, said graphite is synthetic crystalline graphite.

When the carbon species are detached from the cathode, they are incorporated to the alloy by entrainment of the plasma gas generated by the plasma arc, the part of the cathode in contact with the plasma gas comprising synthetic crystalline graphite.

The cathode of the plasma torch is arranged on the surface of the metal at a height variable at will, from which an electric arc is generated which impinges on the surface of the cast iron alloy. This cathode has a central hole in its entire length through which a plasmagenic gas, preferably an inert gas (nitrogen, argon . . . ) is introduced. When an electric current is applied and the arc is established, the temperature of the cathode rises due to the dual effect of the passage of current and the radiation of the arc itself, such temperature reaching its maximum value at the tip of the electrode since it is the area of contact of the arc. Temperatures greater than 4,000° C. are reached in its core, which causes the rapid heating of the tip of the electrode and the detachment of carbon species starts. These carbon species are entrained by the plasma gas itself and injected in the cast iron alloy, acting as a powerful inoculant which is homogeneously distributed in the molten mass as a result of the actual action of the plasma and of the movement of the cast iron alloy inside the pouring distributor.

The regulation of the supply of carbon species from the cathode is carried out by means of the control of the power of the plasma torch applied and the plasmagenic gas flow rate used in each moment, both of them acting in a directly proportional manner since the supply increases to the extent that the temperature of the cathode and the entrainment capacity of the gas, respectively, increase. Identical results can thus be obtained by means of the balance of gas flow rate and the power applied. If work is carried out with low power, it is necessary to increase the gas flow rate to accelerate the entrainment effect; in contrast, with high powers, the flow rate must be decreased to maintain the same volume of supply of carbon species.

When the anode comprises graphite, the nucleating additive is detached therefrom and is incorporated to the iron alloy by the contact of the anode with the cast iron alloy, the part of the anode in contact with the cast iron alloy comprising graphite, preferably synthetic crystalline graphite.

The anode is the second electrode of the plasma torch and its principle of supply of carbon species differs from the principle of the cathode by its function and arrangement in the assembly. Given that the current circuit is closed through the anode which is immersed in the cast iron alloy, this involves two considerable differences with respect to the cathode. Firstly, there is no arc at the tip of the anode, and therefore both the temperature in the area of contact of the anode with the cast iron alloy is considerably lower than that of the cathode, since it is permanently cooled with the cast iron alloy surrounding it. Secondly, the anode is solid and this means that the entrainment function of the plasmagenic gas which occurs, where appropriate, in the cathode as has been set forth above, is substituted with the abrasion and dilution exerted by the cast iron alloy in its movement in the pouring distributor.

The power of inoculation of the anode is essentially based in the capacity of the system for incorporating the exact and necessary amount of inoculant required in each moment of the pouring to the cast iron alloy. The anode can be immersed in the alloy at will, without thus modifying the power setpoint or other electric variables. The result is that the anode area (graphite area) exposed to the abrasive action of the cast iron alloy can be controlled in a discretional and immediate manner.

In the event that the anode and cathode comprise graphite, the nucleating additive is detached from the both the anode and the cathode through the mechanisms mentioned above for the individual embodiments of graphite anode and graphite cathode, the inoculating effects of both electrodes (anode and cathode) thus being added.

Furthermore, the anode and the cathode can be arranged such that the radiation of the plasma arc generated in the cathode acts on the non-immersed part of the anode, causing the heating of the anode (for example, the anode and cathode being housed in one and the same chamber). In this case, the volume of incorporation of graphite species is furthermore favored by the high temperature which is reached in the non-immersed part of the anode and which is transmitted by conduction to the part immersed in the alloy. This temperature is directly proportional to the power applied in the plasma arc since said heating mainly occurs due to the radiation coming from the arc. Therefore, in those arrangements in which the anode and the cathode are located in one and the same chamber, the control of the degree of inoculation must contemplate this variable due to its high impact in the acceleration of the process.

As a whole, the variables involved in the mechanics of the inoculation are the flow rate, speed and temperature of the cast iron alloy, on one hand, and the power applied, the plasmagenic gas flow rate, the distance between the anode and the cathode and the surface of contact of the anode with the cast iron alloy on the other hand. Evidently, the operation is controlled by means of the adaptation of the work parameters of the plasma system to the needs imposed by metallurgy and the poured metal flow rate in real time, maintaining at all times the precise degree of inoculation in the metal arranged for its immediate pouring. This inoculation process allows reaching much higher precision and reliability levels than the standards existing on the market.

The process of the invention can theoretically be carried out in any conventional pouring distributor. In a particular embodiment of the process of the present invention, the pouring distributor has a configuration selected from: 1) runner or spout of a pouring furnace; 2) a pouring trough (for example Tundish); 3) a tilting pouring ladle; and 4) a ladle with transfer to a pouring tray.

Therefore, an important advantage of the process of the invention lies in that it allows the unitary and variable management of the electrodes (anode and cathode), and of the conditions and the parameters indicated: power of the plasma torch, pouring flow rate, pouring temperature and immersed area of the surface of the anode, which results in absolute control of the inoculation. The process allows having a wide range of possibilities of supplying carbon species to the cast iron alloy which circulates in the pouring direction, such that the final metallurgical quality can be continuously adapted to the demands marked by the production and according to the analytical control guidelines used in casting.

Another very important advantage is derived from the position of the transferred arc plasma torch in the pouring distributor since the points of supply of the additive are close to the molding line, which allows obtaining a high nucleation yield due to the virtual elimination of the fading effect.

Differential Thermal Analysis (DTA) has been used to determine the effect of the inoculation process on a cast iron alloy. DTA is a tool predicting the metallurgical quality of alloys in liquid state and, therefore, knowing in advance the formation of phases after the solidification. With DTA it is possible to evaluate in an integrated manner the combined effect of all the variables affecting the nucleation of the phases present in the metallographic structure of the material, together with the possibility of estimating the probability of the appearance of defects of metallurgic type (cementite) and/or of feed type (shrinkage cavity).

This technique is based on the interpretation of the cooling curves of the alloy during solidification. A cooling curve is the representation of the evolution of the temperature according to time, of a sample which has been poured in a standardized mold, with a thermocouple located in the center.

By means of the mathematical interpretation of the cooling curves, it is possible to determine the critical temperatures at which internal structure transformations occur during the solidification of the metal.

The interpretation of the cooling curves and of their critical points is complex. Some of the most important transformation parameters and temperatures are the following:

Lower eutectic temperature ($T_{Elow}$): It is the temperature at which the loss of heat resulting from the cooling of the part is compensated by the heat given off in the eutectic reaction of precipitation of graphite. This temperature is in gray cast iron a measure of the nucleation state of the metal.

Recalescence (R): Recalescence measures in ° C. the difference between the $T_{Elow}$ described above and the Higher eutectic temperature ($T_{Ehigh}$), which is the temperature reached by the material resulting from the heat given off during the nucleation and precipitation of graphite.

For the purpose of obtaining healthy parts, it is convenient to have low recalescence values and a lower eutectic temperature ($T_{Elow}$) which is as high as possible. The precipitation of undercooled graphites or even the presence of cementite is thus prevented and, on the other hand, the graphite expansion will be compensated in the secondary contraction, preventing shrinkage cavities and internal porosities.

It has been possible to verify that the inoculation process of the invention the recalescence of the cast iron alloy decreases and the lower eutectic temperature increases.

An inoculation device for inoculating a nucleating additive to a cast iron alloy is also an object of the invention, which device comprises a transferred arc plasma torch and a pouring distributor in which the plasma torch is arranged in said pouring distributor located before the line of molds, the mentioned plasma torch comprising an anode partially immersed in a cast iron alloy contained in the pouring distributor and a cathode located on the surface of said cast iron alloy, to establish a plasma arc between the cathode and the surface of the molten alloy, the anode or the cathode or both comprising graphite which supplies said nucleating additive to the cast iron alloy.

The graphite can be synthetic crystalline graphite.

The anode can be provided with means for regulating the area of the surface of the anode which is immersed in the cast iron alloy. The possibility of regulating the amount of anode which is immersed in the cast iron alloy allows controlling the amount of anode which melts and therefore the amount of nucleating additive which is inoculated to the cast iron alloy from the anode.

For example, on one hand, the pouring temperature is controlled by means of the regular application of power depending on the temperature range fixed for each reference and the temperatures registered in the distributor itself and/or in the pouring stream, i.e., in the moment in which the metal is transferred to the mold. Whereas the inoculation is in turn regulated depending on the power applied in a certain moment. Thus, for the case in which the anode and the cathode are of graphite, if the power is high, the immersion depth of the anode is proportionally reduced since the transfer of carbon species is preferably carried out from the cathode. However, when the power is reduced, the anode is immersed to a greater depth to offer a larger dissolution surface and thus compensate the lower transfer of carbon species by the cathode.

The plasma torch can comprise means for regulating the power of the plasma arc.

The pouring distributor can have a configuration selected from among:

1) runner or spout of a pouring furnace. These furnaces have a central storage tank and a charging hole for the filling of the metal coming from the melting furnace. The tanks are leak-tight and the metal moves to the pouring spout due to the effect of the pressure of a gas which is injected into the tank. Nitrogen is commonly used for the pressurization of the tank since it is an inert gas which does not affect the composition of the metal, although air is used in the manufacture of gray or and malleable cast iron since they do not contain easily oxidizable elements. When the metal has reached its work level in the spout, the heating and inoculation of the bath by means of the electrodes is started. The position thereof in the spout is mainly conditioned by the dimensions of such spout and can be altered discretionally without this involving any reduction in the performance thereof. The metal is poured to the mold through the pouring nozzle assembled in the bottom of the spout and located on the axis of the mold filling cup. The filling flow rate is regulated by means of the stopper or plug for closing the nozzle. The level of metal in the spout is maintained constant by means of regulating the pressure exerted inside the storage tank and is controlled in the surface by contact electrodes. In a device of this type, as depicted in FIG. 1, the anode can be located both upstream a-1 or downstream a-2 with respect to the position of the cathode (C) in the spout.
2) Pouring trough. This pouring device is a simplification of the pressurized furnace and basically consists of an open tank into which the molten metal is poured and maintained during the pouring. The discharge system is made up of the same elements, i.e., assembly of nozzle and stopper and, unlike the previous one, the level of the metal in the trough is not constant since it decreases as the pouring progresses. The effects of the heating and the inoculation are transmitted to the entire mass of stored metal and, as indicated in the diagram, the arrangement of the electrodes of the plasma system can be freely modified according to the geometry of the trough. Also in this case, the anode can be located upstream a-1 or downstream a-2 with respect to the position of the cathode (C) in the spout.
3) Tilting ladle. This type of ladle is mainly used in horizontal molding lines and for medium-high mold weights (greater than 25 Kg) due to the difficulty involved in the adjustment of flow rates of pouring by direct tilting to the mold. Due to its special geometry, the options of inoculation by the anode are limited to the storage tank by means of an anode which descends together with the level of metal such that, in a maintenance situation. A location of the anode in position a-1 or a-2 can be chosen. However, the cathode can be located in c-1 or c-2 depending on the particular needs of the casting, c-1 for the maintenance in waiting periods and c-2 for the control of temperature in pouring being recommended.
4) A ladle with transfer to a pouring tray. This is a variant of the tilting ladle in which the intermediate transfer from the supply ladle to a pouring tray which is located in the axis of the mold filling cup is set forth as an option. This system allows the assembly of a dual plasma system in which there is a first plasma torch, with the electrodes a-1 and c-1, installed in the supply or feeding ladle, in which the inoculation is carried out and the temperature of the metal is maintained. As complementary equipment, it can incorporate a low-power plasma torch a-2, c-2 for adjusting the pouring temperature in the intermediate tray itself.

The anode and cathode can be located in the pouring distributor located in the axis of circulation and discharge direction towards the mold of the molten iron alloy.

The anode or the cathode or both can be arranged in a closed chamber in an inert atmosphere.

The plasma torch can act as a heating means which can increase the temperature of the cast iron alloy for adjusting it to a setpoint pouring temperature, with a tolerance less than ±5° C.

Illustrative examples of the invention are presented below which are set forth to better understand the invention and in no case must be considered as a limitation of the scope thereof.

EXAMPLES

Example 1

Figure 3:
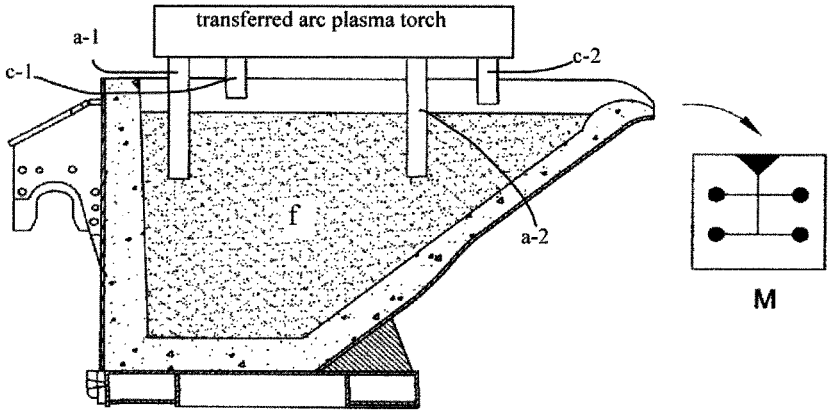
FIG. 3 is a diagram of a pouring distributor with a tilting pouring ladle configuration in which c-1 and c-2 indicate two possible positions of the cathode in the spout of the ladle or in the tank of the ladle and a-1 and a-2 indicate the possible positions of the anode.
Figure 4:
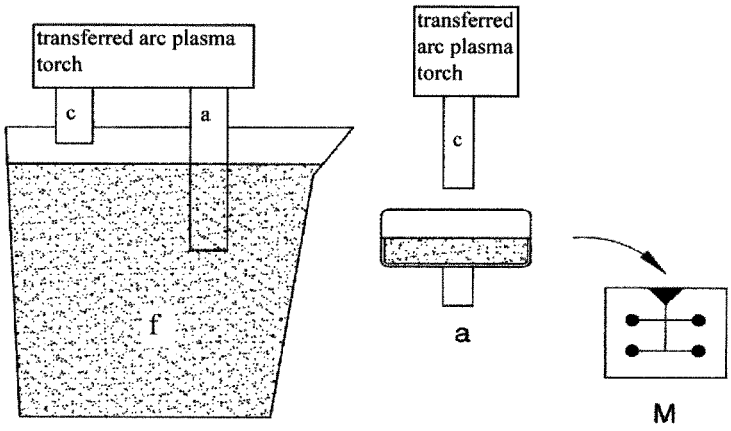
FIG. 4 is a diagram of a pouring distributor with a configuration of a ladle with transfer to a pouring tray in which a and c represent the possible position of the anode and the cathode in the pouring distributor and c represents the position of the cathode in the pouring tray.

Step of Inoculation During the Process for Manufacturing a Gray Cast Iron Part The step of inoculation was carried out statically in a tilting pouring ladle (FIG. 3). The metal used was gray cast iron (600 Kg added to the ladle). An anode of synthetic crystalline graphite with a diameter of 50 mm was used. The cathode used was of perforated synthetic graphite of 8 mm. The distance between the anode and the cathode was 230 mm. The immersion depth of the anode was 50 mm.

UHP (Ultra High Purity) electrodes (anode and cathode) were used, the characteristics of which are:

Specific electrical resistivity: 6.5 μΩ/meter
Torsional strength: 9.0 Mpa.
Modulus of elasticity: 12.0 GPa
Max ashes: 0.3%.
Grain density: 1.65 g/cm$^3$.

The test time was 95 minutes during which the temperature of the bath was maintained constant at 1430° C. The mean power applied was 57 Kw.

The carbon content at the start of the test was 3.47% and the carbon content at the end of the test was 3.48% (both % by weight with respect to the total weight of the hotmelt). Said content was determined by means of LECOY emission spectrometry. The temperature of the eutectic (Telow) at the start of the test was 1,147° C. and the temperature of the eutectic at the end of the test was 1,151° C.

The anode consumption was 2.4 grams/Kw.

The cathode consumption was 1.8 grams/Kw.

Figure 5:
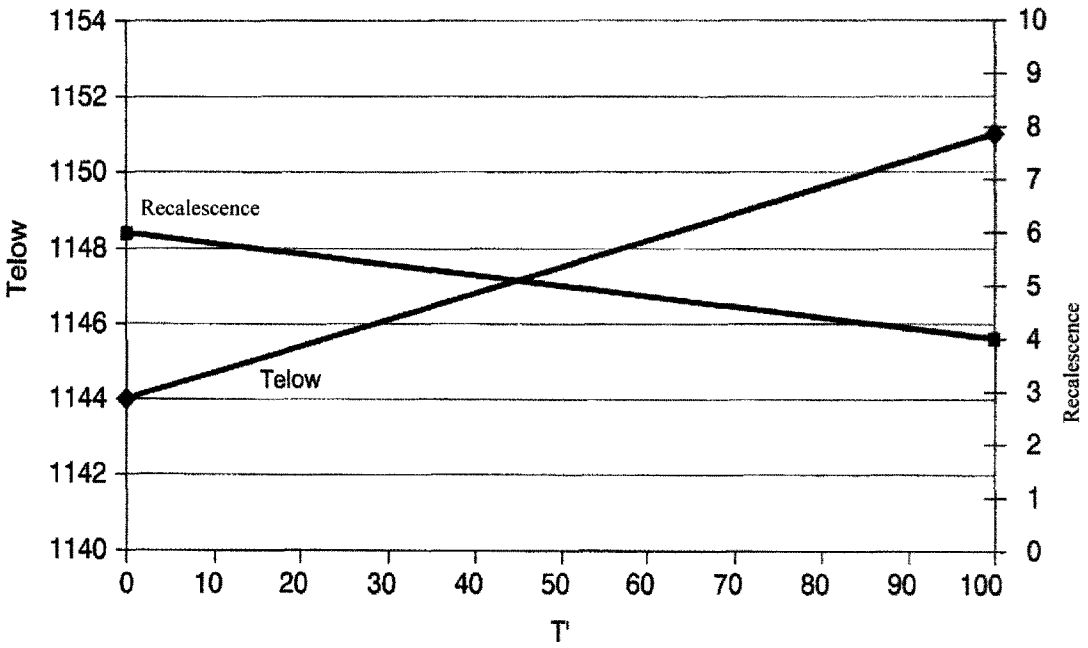
FIG. 5 shows a static cooling curve, indicating the evolution of TeLow and Recalescence in a cast iron alloy using the inoculation process of the invention.

FIG. 5 shows the cooling curve of the cast iron alloy, indicating the evolution of TeLow and Recalescence.

Example 2

Step of Inoculation During the Process for Manufacturing a Nodular Cast Iron Part The step of inoculation was carried out dynamically in a pouring runner with an inducer (Presspour) (FIG. 1). The metal used was nodular cast iron, the weight of metal in the runner being 280 Kg and the pouring rate being 7.2 Ton/hour. The arrangement of the electrodes was with the anode upstream of the cathode.

An anode of synthetic crystalline graphite or with a diameter of 50 mm was used. The cathode used was of perforated synthetic crystalline graphite of 8 mm.

UHP (Ultra High Purity) electrodes (anode and cathode) were used, the characteristics of which are:

Specific electrical resistivity: 6.5 μΩ/meter

Torsional strength: 9.0 Mpa.

Modulus of elasticity: 12.0 GPa

Max ashes: 0.3%.

Grain density: 1.65 g/cm$^3$.

The distance between the anode and the cathode was 180 mm. The immersion depth of the anode was 70 mm. The test time was 180 min during which the temperature of the bath was maintained between 1390 and 1410° C. The mean power applied by the plasma was 24 Kw and 150 Kw in the inducer.

The temperature of the eutectic (Telow) at the start of the test was 1,138° C. and the temperature of the eutectic at the end of the test was 1,141° C.

The anode consumption was 3.8 grams/Kw.

The cathode consumption was 0.4 grams/Kw.

Figure 6:
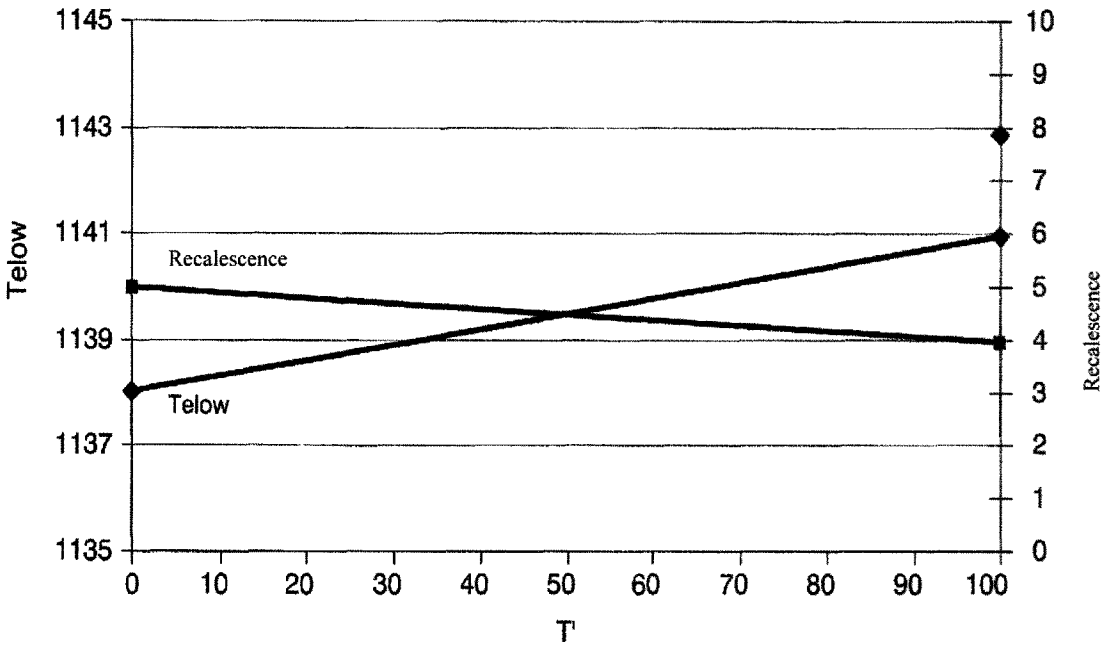
FIG. 6 shows a dynamic cooling curve, indicating the evolution of TeLow and Recalescence in a cast iron alloy using the inoculation process of the invention.

FIG. 6 shows the cooling curve of the cast iron alloy, indicating the evolution of TeLow and Recalescence.

The invention claimed is:

1. A process for inoculating a cast iron alloy, which comprises establishing a plasma arc between a surface of said alloy and a cathode of a transferred arc plasma torch arranged in a pouring distributor located before an alloy mold, the transferred arc plasma torch comprising an anode partially immersed in the cast iron alloy and the cathode being arranged on the alloy, wherein the anode or the cathode or both comprise graphite which supplies a nucleating additive to the iron alloy.

2. The process according to claim 1, wherein the cathode comprises graphite.

3. The process according to claim 1, wherein the anode comprises graphite.

4. The process according to claim 1, wherein the cathode and the anode comprise graphite.

5. The process according to claim 4, wherein the anode and the cathode are arranged such that a radiation of the plasma arc generated in the cathode acts on a part of the anode which is not immersed in the cast iron alloy, thereby causing heating of the anode.

6. The process according to claim 1, wherein the graphite is synthetic crystalline graphite.

7. The process according to claim 1, wherein a part of the cathode is in contact with a plasma gas generated by the plasma arc, said part of the cathode comprising synthetic crystalline graphite, and wherein the nucleating additive is detached from the cathode and incorporated in the cast iron alloy by entrainment of the plasma gas generated by the plasma arc.

8. The process according to claim 1, wherein the part of the anode immersed in the cast iron alloy comprises synthetic crystalline graphite, and the nucleating additive is detached from the anode and incorporated in the cast iron alloy by contact of the anode with the cast iron alloy.

9. A device for inoculating a cast iron alloy, comprising (i) a transferred arc plasma torch and (ii) a pouring distributor located before a mold, said plasma torch being arranged in said pouring distributor, the plasma torch comprising an anode positioned to be partially immersed in a molten cast iron alloy contained in the pouring distributor and a cathode positioned for establishing a plasma arc between the cathode and a surface of the molten alloy, wherein the anode or the cathode or both comprises graphite which is configured to supply a nucleating additive to the cast iron alloy.

10. The device according to claim 9, wherein the graphite is synthetic crystalline graphite.

11. The device according to claim 9, wherein the pouring distributor has a configuration selected from the group consisting of: 1) runner or spout of a pouring furnace; 2) a trough; 3) a tilting pouring ladle; and 4) a ladle with transfer to a pouring tray.

12. The device according to claim 11, wherein the anode and the cathode are in the pouring distributor located in an axis of circulation and discharge direction towards the mold.

13. The device according to claim 12, wherein the anode or the cathode or both are arranged inside a closed chamber in an inert atmosphere.

14. The device according to claim 9, wherein the plasma torch is a heating means which can increase the cast iron alloy's temperature for adjusting it to a setpoint pouring temperature, with a tolerance of less than ±5° C.

15. The device according to claim 9, wherein the device is configured to regulate the amount of the anode which is immersed in the cast iron alloy.

* * * * *